US011292274B2

(12) United States Patent
Murata

(10) Patent No.: US 11,292,274 B2
(45) Date of Patent: Apr. 5, 2022

(54) PRINTING UNIT AND PRINTER

(71) Applicant: Seiko Instruments Inc., Chiba (JP)
(72) Inventor: Tomohiro Murata, Chiba (JP)
(73) Assignee: SEIKO INSTRUMENTS INC., Chiba (JP)

( * ) Notice: Subject to any disclaimer, the term of this patent is extended or adjusted under 35 U.S.C. 154(b) by 7 days.

(21) Appl. No.: 17/083,547
(22) Filed: Oct. 29, 2020
(65) Prior Publication Data
US 2021/0129556 A1 May 6, 2021
(30) Foreign Application Priority Data
Oct. 31, 2019 (JP) ..... JP2019-198162
(51) Int. Cl.
*B41J 11/00* (2006.01)
(52) U.S. Cl.
CPC ..... *B41J 11/0095* (2013.01)
(58) Field of Classification Search
CPC ..... B41J 11/0095
See application file for complete search history.

(56) References Cited

U.S. PATENT DOCUMENTS

| | | | | |
|---|---|---|---|---|
| 5,079,565 | A | 1/1992 | Shimizu et al. | |
| 2014/0147187 | A1* | 5/2014 | Jo | B41J 29/02 400/613 |
| 2017/0036455 | A1 | 2/2017 | Murata | |

FOREIGN PATENT DOCUMENTS

| | | | |
|---|---|---|---|
| EP | 2018971 | A2 | 1/2009 |
| EP | 2018971 | A3 | 3/2014 |
| EP | 3275667 | A1 | 1/2018 |
| JP | 2005-178309 | A | 7/2005 |

OTHER PUBLICATIONS

Extended European Search Report in Europe Application No. 20205029.0, dated Mar. 2, 2021, 7 pages.

* cited by examiner

*Primary Examiner* — Justin Seo
(74) *Attorney, Agent, or Firm* — Crowell & Moring LLP

(57) ABSTRACT

A printing unit, includes a head unit including: a thermal head; and a platen unit combined with the head unit. The platen unit including: a platen roller configured to feed a recording sheet while sandwiching the recording sheet together with the thermal head; a platen frame configured to support the platen roller in a rotatable manner; a sensor unit including: a sensor configured to detect the recording sheet; a connector connected to the sensor; and a connection portion configured to connect the sensor and the connector to each other; and a sensor holder, which is mounted to the platen frame, and includes: a plurality of connector arrangement portions through which a terminal of the connector is to be exposed; and a plurality of sensor receiving portions in which the sensor unit is to be received.

5 Claims, 9 Drawing Sheets

PRINTING UNIT AND PRINTER

RELATED APPLICATIONS

This application claims priority to Japanese Patent Application No. 2019-198162, filed on Oct. 31, 2019, the entire content of which is incorporated herein by reference.

BACKGROUND OF THE INVENTION

1. Field of the Invention

The present invention relates to a printing unit and a printer.

2. Description of the Related Art

Hitherto, there have been disclosed configurations of printers configured to perform printing on a recording sheet such as a label or a tag. For those printers, there have been proposed various technologies for detecting a position of the recording sheet through scanning of a mark formed on the recording sheet by, for example, a sensor.

As the related art described above, for example, there has been known the following configuration of a printer capable of opening and closing a printing portion. Specifically, the printer includes: a sensor support device to which a sensor for a printing medium is mounted; and a moving mechanism capable of moving and adjusting the sensor support device in a direction orthogonal to a feeding direction of a recording sheet under a state in which the printing portion is opened. According to the related art, the sensor support device can be retained after being moved to a predetermined position along the moving mechanism. With this configuration, for example, when using recording sheets different from each other in mark position, a position of the sensor is moved so as to be adapted to a position of a mark. Thus, a position of the recording sheet is detected.

However, in the related art described above, it is required to provide the moving mechanism configured to move the sensor support device, and hence there is a fear in that the configuration of the printer is complicated. Further, it is required to secure a redundant length of, for example, wiring configured to connect the sensor support device and a main body to each other in order to be adapted to different detection positions. Accordingly, the length of the wiring is increased, and, for example, a space for receiving the wiring having the redundant length is required. As a result, there is a fear in that the printer is increased in size.

Therefore, in the technical field of the present invention, there has been a demand for a printing unit capable of performing position detection on recording sheets different from each other in mark position with a configuration simpler and smaller than the configuration of the related art, and for a printer employing the printing unit.

SUMMARY OF THE INVENTION

According to one embodiment of the present invention, there is provided a printing unit, including: a head unit including a thermal head; and a platen unit combined with the head unit, the platen unit including: a platen roller configured to feed a recording sheet while sandwiching the recording sheet together with the thermal head; a platen frame configured to support the platen roller in a rotatable manner; a sensor unit including: a sensor configured to detect the recording sheet; a connector connected to the sensor; and a connection portion configured to connect the sensor and the connector to each other; and a sensor holder, which is mounted to the platen frame, and includes: a plurality of connector arrangement portions through which a terminal of the connector is to be exposed; and a plurality of sensor receiving portions in which the sensor unit is to be received.

In the above-mentioned thermal printer according to the one embodiment of the present invention, wherein the connection portion is a board, and wherein the sensor and the connector are mounted to the single board.

In the above-mentioned thermal printer according to the one embodiment of the present invention, wherein the board is a flexible board, and wherein the sensor unit includes: a sub-unit including the sensor, the connector, and the flexible board that are integrated with one another; and a sensor bracket to which the sub-unit is mounted.

In the above-mentioned thermal printer according to the one embodiment of the present invention, wherein the sensor bracket includes an engagement portion with which the flexible board is engageable.

According to one embodiment of the present invention, there is provided a printer, including: the printing unit; and a casing to which the printing unit is assembled.

DETAILED DESCRIPTION OF THE PREFERRED EMBODIMENTS

Now, an embodiment of the present invention is described with reference to the drawings. In the following description, components having the same or similar function are denoted by the same reference symbols. In some cases, overlapping description of the components is omitted.

Figure 1:
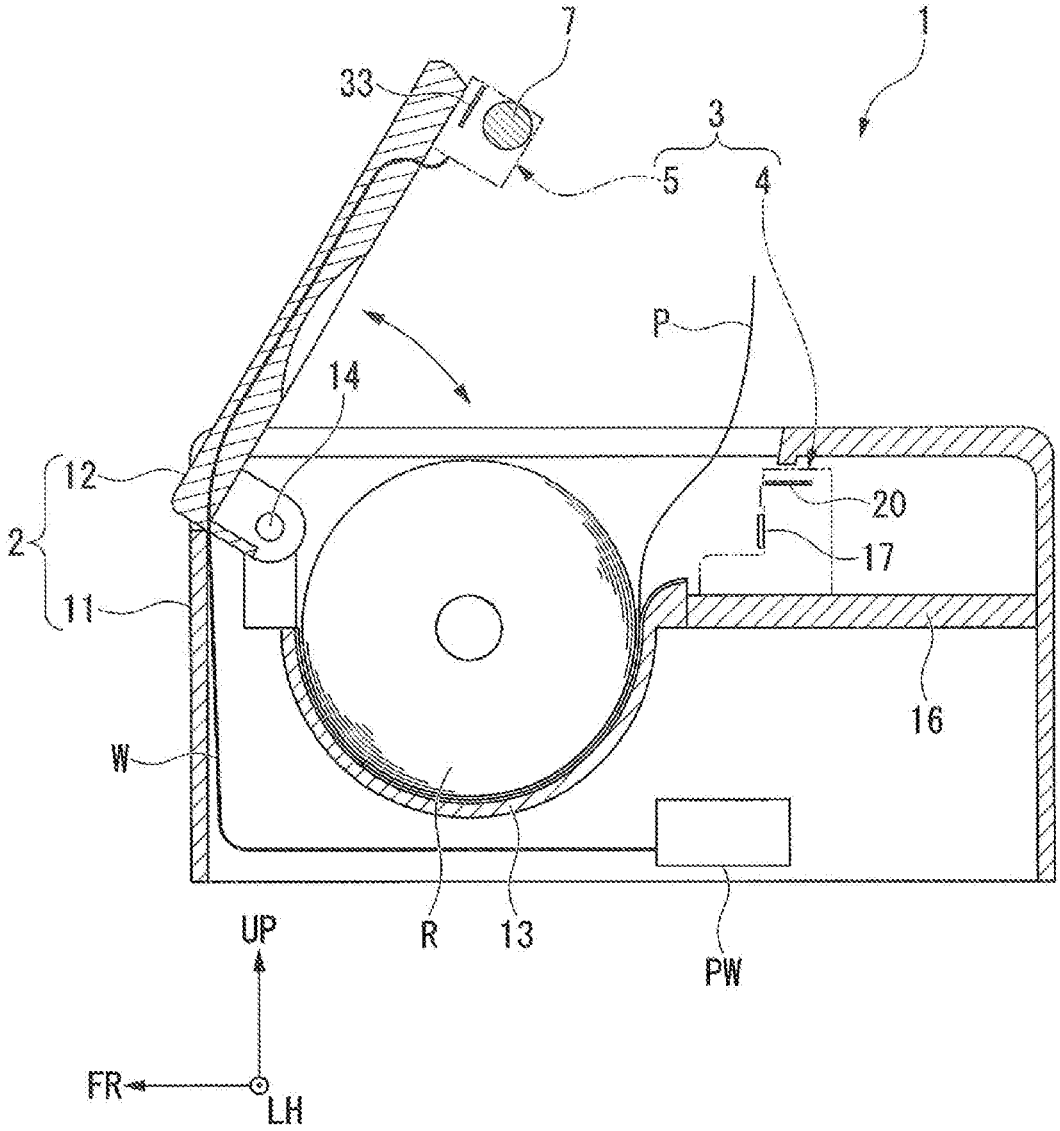
FIG. 1 is a sectional view for illustrating a thermal printer according to an embodiment of the present invention when a printer cover is at an opening position.
Figure 2:
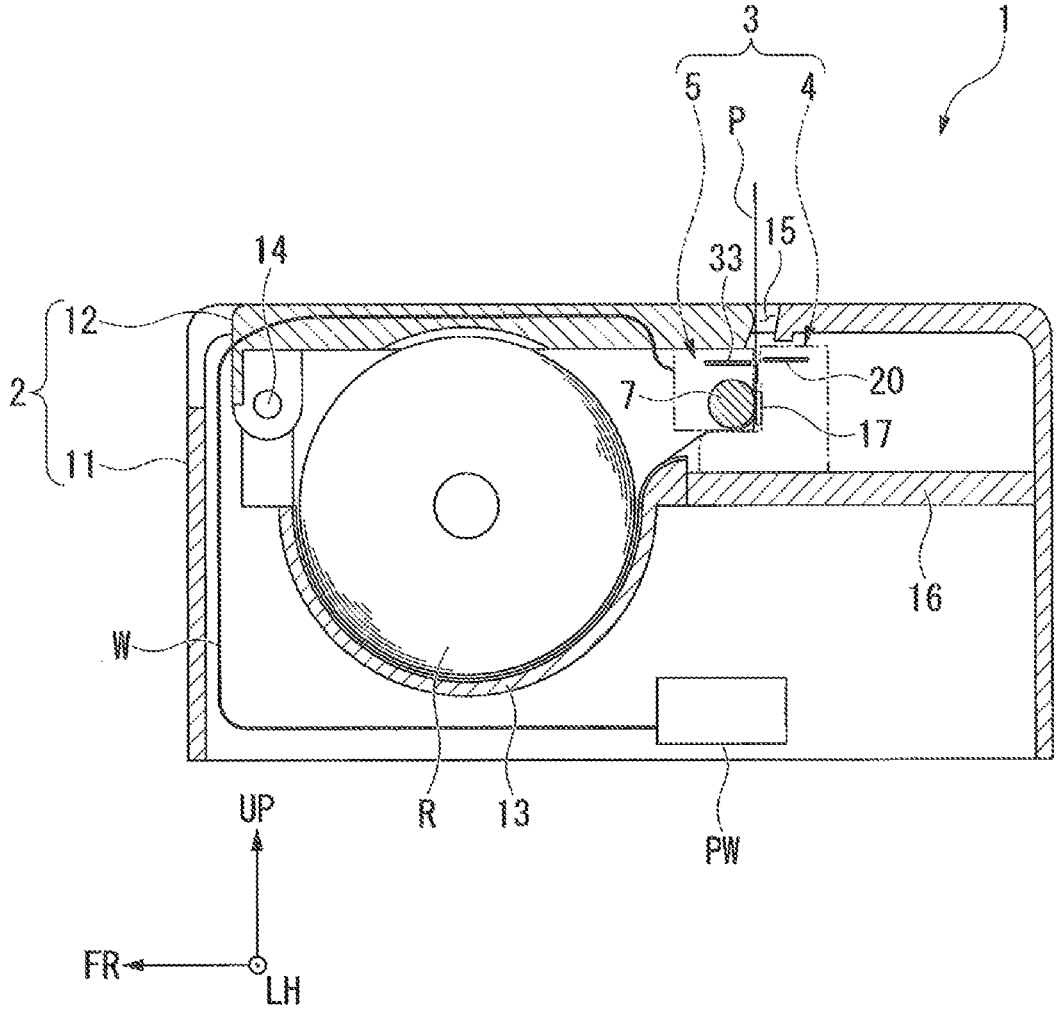
FIG. 2 is a sectional view for illustrating the thermal printer according to the embodiment of the present invention when the printer cover is at a closing position.

FIG. 1 is a sectional view for illustrating a thermal printer 1 (printer of claims) according to the embodiment of the present invention when a printer cover 12 is at an opening position. FIG. 2 is a sectional view for illustrating the thermal printer 1 according to the embodiment of the present invention when the printer cover 12 is at a closing position.

In the embodiment of the present invention, the example illustrated in FIG. 1 is described with an up-and-down direction of the drawing sheet being simply referred to and defined as an up-and-down direction, a direction orthogonal to the drawing sheet as a right-and-left direction, and a direction orthogonal to the up-and-down direction and the right-and-left direction as a front-and-rear direction. Further, the reference symbols UP, LH, and FR in the drawings represent an upper side, a left side, and a front side of the thermal printer, respectively. The thermal printer 1 includes a casing 2, and a printing unit 3 assembled to the casing 2.

The casing 2 includes a casing main body 11 and the printer cover 12. A roll sheet R is received in the casing 2. The roll sheet R is formed of a wound recording sheet P. In the embodiment of the present invention, the recording sheet P is, for example, a band-shaped release paper sheet having a plurality of seal labels provided thereon. A mark for label position detection (not shown) is formed between adjacent seal labels.

The casing main body 11 is formed into a box shape. The casing main body 11 includes a roll sheet receiving portion 13 configured to receive the roll sheet R. The printer cover 12 is coupled to the casing main body 11 through intermediation of a hinge portion 14 so as to be pivotable. The printer cover 12 is configured to open and close the roll sheet receiving portion 13 between the opening position of opening the roll sheet receiving portion 13, and the closing position of closing the roll sheet receiving portion 13. As illustrated in FIG. 2, when the printer cover 12 is at the closing position, a delivery port 15 (see FIG. 2) is defined between an opening edge of the roll sheet receiving portion 13 and a distal end portion of the printer cover 12. The delivery port 15 is configured to allow the recording sheet P drawn from the roll sheet R to be delivered to an outside (upper side) of the thermal printer.

Figure 3:
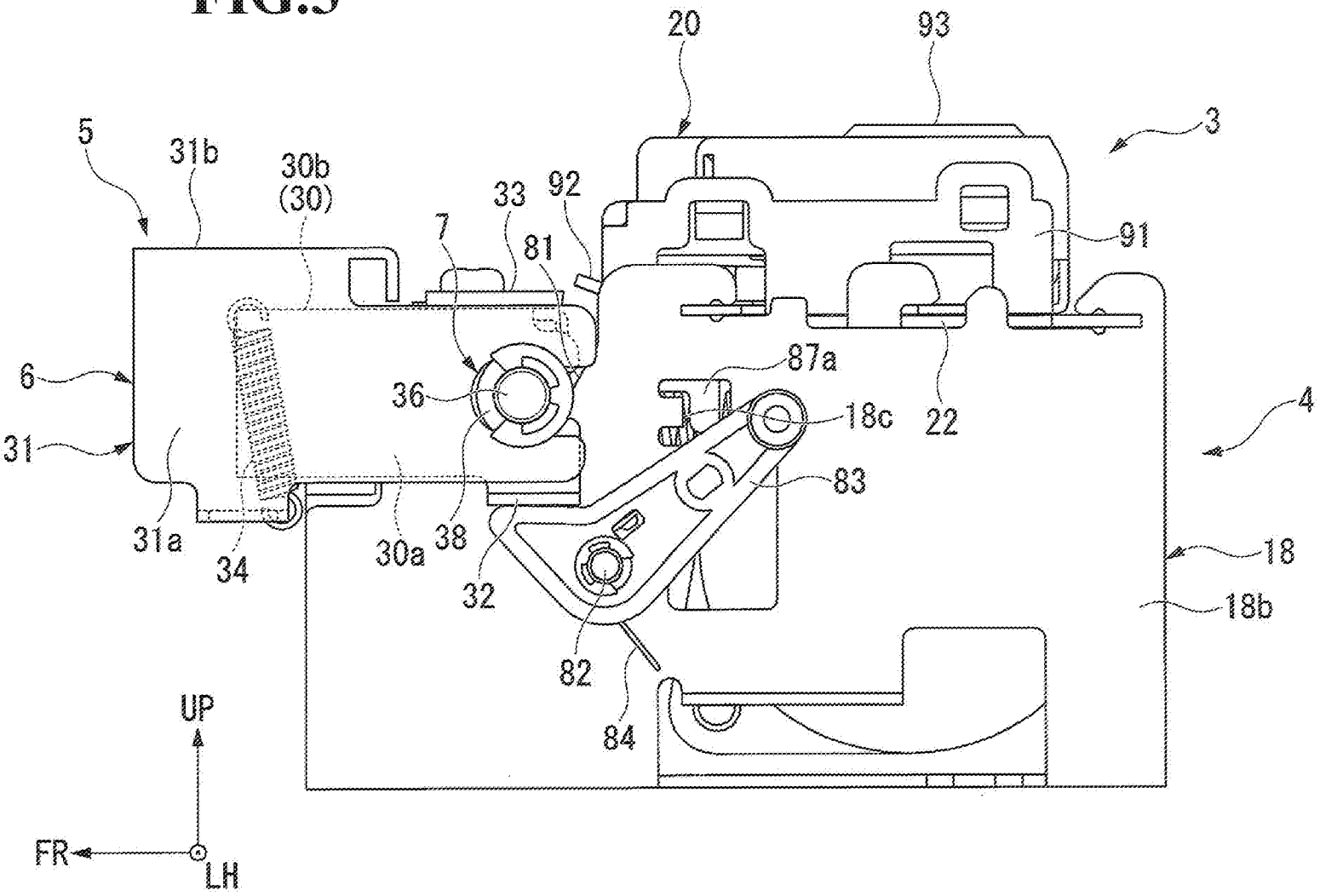
FIG. 3 is a side view for illustrating a printing unit according to the embodiment of the present invention.

FIG. 3 is a side view for illustrating the printing unit 3 according to the embodiment of the present invention. The printing unit 3 includes a head unit 4 and a platen unit 5 detachably combined with each other.

The head unit 4 is assembled to the casing main body 11. As illustrated in FIG. 1, on an inner plate 16 arranged adjacent to the roll sheet receiving portion 13, the head unit 4 is fixed under a state in which a thermal head 17 is directed to the roll sheet receiving portion 13 side.

Figure 4:
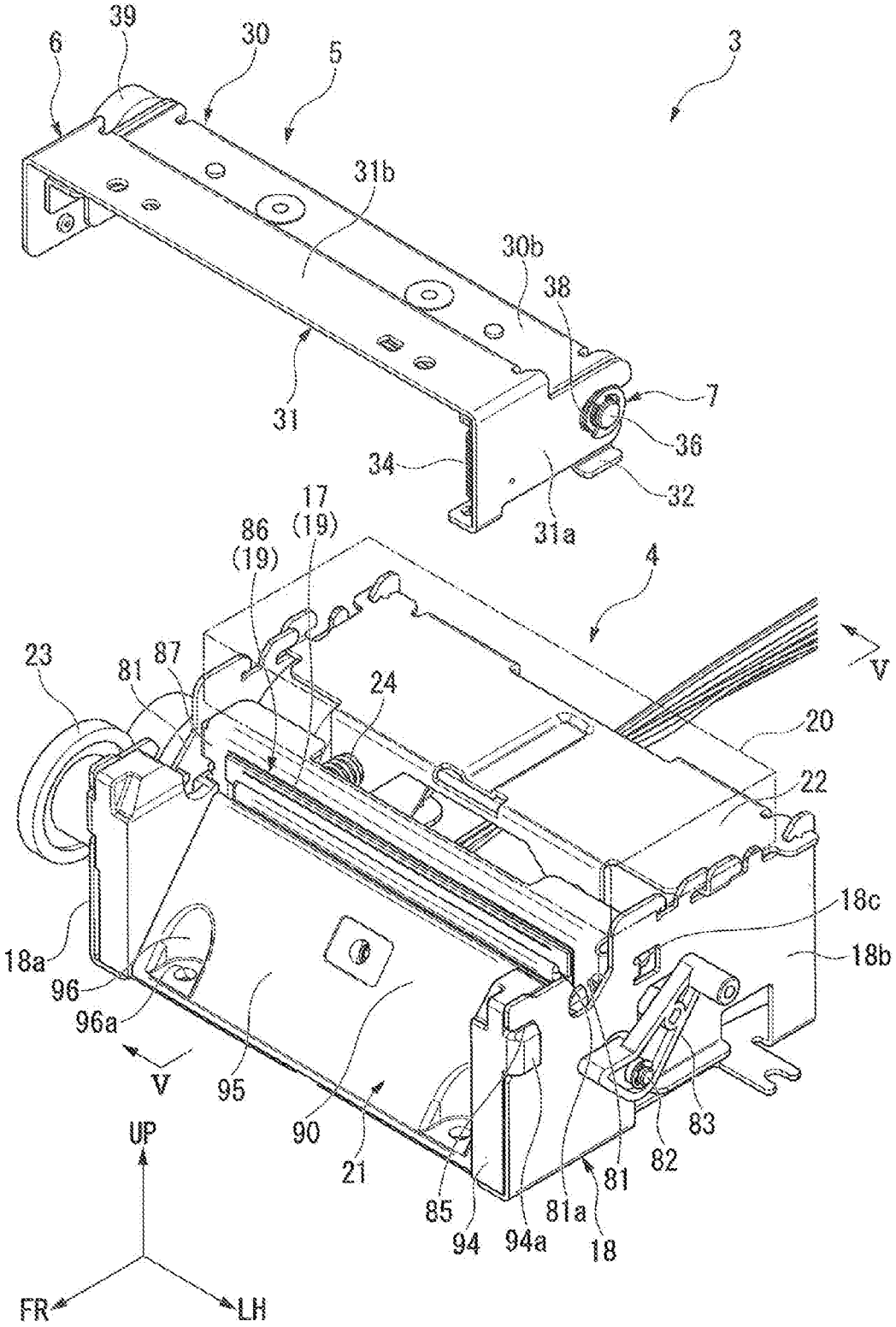
FIG. 4 is an exploded perspective view for illustrating the printing unit according to the embodiment of the present invention.
Figure 5:
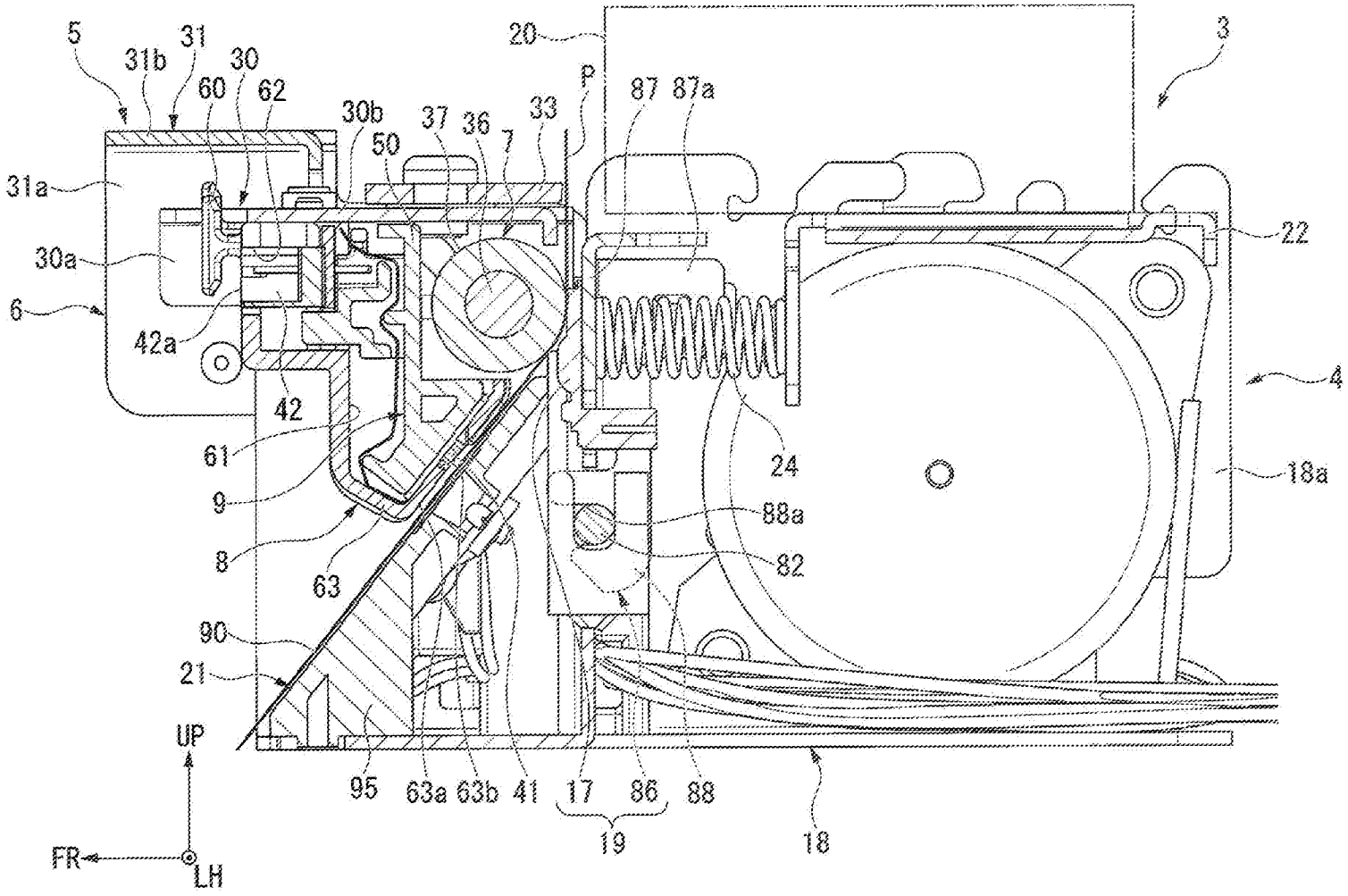
FIG. 5 is a sectional view taken along the line V-V of FIG. 4.

FIG. 4 is an exploded perspective view for illustrating the printing unit 3 according to the embodiment of the present invention. FIG. 5 is a sectional view taken along the line V-V of FIG. 4. The head unit 4 includes a head frame 18, a head block 19, a movable blade 20, and a guide member 21.

As illustrated in FIG. 4, the head frame 18 is formed into a U shape opened upward in front view when seen from the front-and-rear direction. The head frame 18 includes a pair of side wall portions 18*a* and 18*b* which are located on both sides of the head frame 18 in the right-and-left direction. The pair of side wall portions 18*a* and 18*b* each have a receiving recessed portion 81. The receiving recessed portion 81 is opened upward, and a width of the receiving recessed portion 81 in the front-and-rear direction gradually decreases toward a lower side of the thermal printer. A bearing 38 of a platen roller 7, which is described later in detail, is engaged in the receiving recessed portion 81. A stopper portion 81*a* is formed at an inner peripheral edge of the receiving recessed portion 81 so as to protrude rearward. At the closing position, the stopper portion 81*a* is engaged with the bearing 38 of the platen roller 7 from the upper side of the thermal printer. A positioning recessed portion 85 is formed in a front edge of each of the side wall portions 18*a* and 18*b* so as to be recessed rearward.

A support member 22 is arranged on a rear portion (portion located rearward of the head block 19) of each of the side wall portions 18*a* and 18*b*. The support member 22 is arranged so that a thickness direction of the support member 22 matches the up-and-down direction, and that the support member 22 extends in the right-and-left direction. The support member 22 serves as a bridge between the side wall portions 18*a* and 18*b*. The support member 22 is configured to support the head block 19 from a rear side of the head block 19, and to connect the movable blade 20 and the head frame 18 to each other.

On the right-hand side wall portion 18*a* of the side wall portions 18*a* and 18*b*, a platen gear train mechanism 23 is provided. The platen gear train mechanism 23 is connected to a platen motor (not shown) mounted to the head frame 18. Through rotation of the platen motor, the platen gear train mechanism 23 is rotated. The platen gear train mechanism 23 is configured to transmit a rotational force to the platen roller 7 of the platen unit 5, which is described later in detail.

As illustrated in FIG. 3 and FIG. 5, a pivot shaft 82 is provided between the side wall portions 18*a* and 18*b* of the head frame 18. The pivot shaft 82 is arranged so as to extend in the right-and-left direction. Both end portions of the pivot shaft 82 are inserted and supported in through-holes (not shown) of the side wall portions 18*a* and 18*b*. As illustrated in FIG. 3, a release lever 83 is arranged at a portion of the pivot shaft 82 located more on an outer side than the left-hand side wall portion 18*b*. The release lever 83 is configured to release the combination between the platen unit 5 and the head unit 4.

The release lever 83 is formed into a V shape in side view when seen from the right-and-left direction. A peak portion of the release lever 83 is supported so as to be pivotable about the pivot shaft 82. A lever member (not shown) provided on the casing main body 11 is locked to a portion of the release lever 83 located on one end side with respect to the peak portion. Meanwhile, a portion of the release lever 83 located on another end side with respect to the peak portion is brought into abutment against a projecting piece 32 (see FIG. 4) provided to the platen unit 5 from the lower side of the thermal printer. With this configuration, the release lever 83 pivots in association with operation of the lever member, and pushes the platen unit 5 upward through intermediation of the projecting piece 32, thereby detaching the platen unit 5 from the head unit 4. An urging member 84 is interposed between the release lever 83 and the side wall portion 18*b*. The urging member 84 is configured to urge the release lever 83 in a direction of separating the release lever 83 from the projecting piece 32.

As illustrated in FIG. 4 and FIG. 5, the head block 19 includes a head support 86 and the above-mentioned thermal head 17.

The head support 86 is supported so as to be pivotable about the pivot shaft 82 arranged on the head frame 18. The head support 86 is formed by bending a plate material made of, for example, metal. The head support 86 is arranged inside the head frame 18. Specifically, the head support 86 includes a head support wall 87 and a pair of stays 88. The thermal head 17 is fixed to the head support wall 87. The pair of stays 88 is bent rearward from both end portions of the head support wall 87 in the right-and-left direction, respectively.

The head support wall 87 is arranged with a thickness direction thereof matching the front-and-rear direction and extends in the right-and-left direction. The stays 88 have respective lower end portions located below the head support wall 87. A coupling recessed portion 88*a* is formed in each of the lower end portions of the stays 88, and is configured to receive the pivot shaft 82 described above. The coupling recessed portion 88*a* is formed into a C shape opened forward in side view when seen from the right-and-left direction. With this configuration, the head support 86 is pivotable about the pivot shaft 82 in the front-and-rear direction (direction of approaching and separating from the platen roller 7), and is removably mounted to the pivot shaft 82. Lower edges (portions located below the coupling recessed portions 88*a*) of the stays 88 each have a tapered shape inclining downward as extending rearward. In place of a configuration in which the pivot shaft 82 is inserted in the coupling recessed portions 88*a*, there may be adopted a configuration in which the pivot shaft 82 is inserted in through-holes.

In both end portions of the head support wall 87 in the right-and-left direction, at portions located above the stays 88 described above, stopper engagement portions 87*a* are formed so as to protrude rearward. The stopper engagement portions 87*a* are locked to regulating portions 18*c* of the head frame 18, thereby restricting a pivot range of the head block 19. A head urging member 24 is interposed between the head support wall 87 and the support member 22 in the front-and-rear direction. The head urging member 24 is configured to urge the head block 19 (thermal head 17) toward the platen roller 7 side (front side).

The thermal head 17 is fixed to a front surface of the head support wall 87. The thermal head 17 is formed into a plate shape extending in the right-and-left direction (sheet width direction of the recording sheet P). A plurality of heating elements are arrayed in line on a surface of the thermal head 17.

The movable blade 20 is mounted to an upper side of the head frame 18 (each of the side wall portions 18*a* and 18*b*) through intermediation of the support member 22. As illustrated in FIG. 3, specifically, the movable blade 20 includes a movable blade frame 91, a movable-blade main body 92, and a drive mechanism 93. The movable-blade main body 92 is supported on the movable blade frame 91 so as to be slidable. The drive mechanism 93 is configured to drive the movable-blade main body 92.

The movable blade frame 91 is formed by bending, for example, a metal plate. The movable blade frame 91 is removably mounted on the support member 22. A blade edge of the movable-blade main body 92 is formed into a V shape in plan view when seen from the up-and-down direction. The movable-blade main body 92 is formed so that a length from a root to the blade edge thereof gradually decreases from end portions toward a center of the movable-blade main body 92 in the right-and-left direction. The drive mechanism 93 includes a cutter motor and a gear train mechanism (not shown). The cutter motor is mounted on the movable blade frame 91 so as to be rotatable in forward and reverse directions. The gear train mechanism is connected between the cutter motor and the movable-blade main body 92. When a driving force of the cutter motor is transmitted to the movable-blade main body 92 through the gear train mechanism, the movable-blade main body 92 is moved to slide.

As illustrated in FIG. 4, the guide member 21 is arranged between the side wall portions 18*a* and 18*b* in a front portion of the head frame 18 which supports the head block 19 and the movable blade 20. The guide member 21 is configured to guide the recording sheet P to the thermal head 17. The guide member 21 includes a pair of side blocks 94 located on both right and left sides of the guide member 21, and a guide block 95 serving as a bridge between the side blocks 94. The side blocks 94 are arranged on inner sides of the side wall portions 18*a* and 18*b* of the head frame 18 in the right-and-left direction. A positioning protrusion 94*a* is formed on a front end portion of each of the side blocks 94 so as to protrude outward in the right-and-left direction. The positioning protrusion 94*a* is received in the positioning recessed portion 85 of the head frame 18 from the front side of the thermal printer. The positioning protrusion 94*a* is surrounded by the positioning recessed portion 85 from upper, lower, and rear sides of the positioning protrusion 94*a*.

An upper surface and a front surface of the guide block 95 are recessed downward and rearward with respect to the side blocks 94. Of the guide member 21, the upper surface and the front surface of the guide block 95 and inner surfaces of the side blocks 94 in the right-and-left direction define a guide passage 90. The guide passage 90 inclines upward as extending from the front side to the rear side of the thermal printer. The recording sheet P is caused to pass through the guide passage 90 toward the thermal head 17 (see also FIG. 5). At the closing position, the platen roller 7 is received in the guide passage 90 from the upper side of the thermal printer. The heating elements of the thermal head 17 are exposed in the guide passage 90 from the rear side of the thermal printer.

Recessed portions 96 are formed in a front portion of the guide block 95 so as to be recessed downward. The recessed portions 96 are formed at end portions of the guide block 95 in the right-and-left direction, respectively. In a bottom wall portion of each of the recessed portions 96, a through-hole 96*a* is formed so as to pass through the bottom wall portion of the recessed portion 96 in the up-and-down direction. In the up-and-down direction, the through-holes 96*a* overlap through-holes formed in a bottom wall portion of the head frame 18. Fastening members such as screws (not shown) are inserted through the through-holes 96*a*. The fastening members are fastened to the casing main body 11. Thus, the guide member 21 is fastened to the casing main body 11 together with the head frame 18.

As illustrated in FIG. 2, the platen unit 5 is assembled to a distal end portion of an inner surface of the printer cover 12. Along with opening and closing operation of the printer cover 12, the platen unit 5 is detachably combined with the head unit 4. As illustrated in FIG. 4 and FIG. 5, the platen unit 5 includes a platen frame 6, the platen roller 7, a sensor holder 8, and a sensor unit 9.

Figure 6:
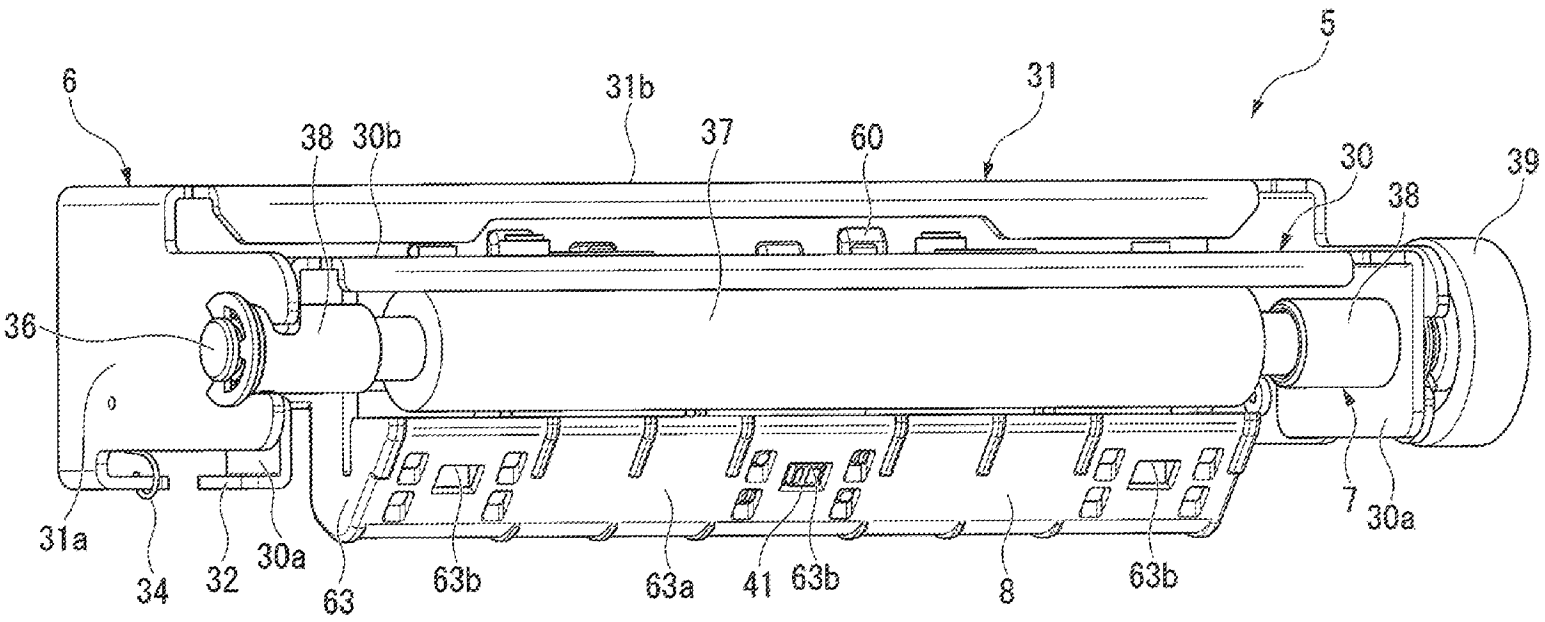
FIG. 6 is a perspective view for illustrating a platen unit in the embodiment of the present invention.

FIG. 6 is a perspective view for illustrating the platen unit 5 in the embodiment of the present invention when seen from a left side and a rear side of the platen unit 5. As illustrated in FIG. 4 and FIG. 6, the platen frame 6 is formed by bending a plate material made of, for example, metal. The platen frame 6 is formed into a U shape opened downward in front view when seen from the front-and-rear direction. The platen frame 6 includes a main frame 30 and a sub-frame 31.

The main frame 30 is formed into a U shape opened downward in front view when seen from the front-and-rear direction. The main frame 30 includes shaft support portions 30*a* and a coupling portion 30*b*. The pair of shaft support portions 30*a* is formed at both end portions of the main frame 30 in the right-and-left direction, respectively. The bearing 38 of the platen roller 7, which is described later, is held in a rear end portion of each of the shaft support portions 30*a*. Further, of the shaft support portions 30*a*, the shaft support portion 30*a* located on the release lever 83 side (left side in the illustrated example) in the right-and-left direction includes the projecting piece 32 formed on a lower end portion thereof so as to protrude outward in the right-and-left direction. The projecting piece 32 is brought into abutment against the release lever 83 provided to the head unit 4.

The coupling portion 30*b* serves as a bridge between the shaft support portions 30*a*. The coupling portion 30*b* extends in the right-and-left direction. A fixed blade 33 is mounted to the coupling portion 30*b* (see FIG. 5). The fixed blade 33 is formed into a plate shape extending in the right-and-left direction. The fixed blade 33 is fixed on the coupling portion 30*b* under a state in which a blade edge of the fixed blade 33 is directed rearward. As illustrated in FIG. 2, when the printer cover 12 is closed so that the platen unit 5 and the head unit 4 are combined with each other, the movable blade 20 and the fixed blade 33 are positioned at predetermined positions so as to be opposed to each other.

The sub-frame 31 is slightly larger than the main frame 30. The sub-frame 31 surrounds the main frame 30 from an upper side and both right and left sides of the main frame 30. Specifically, the sub-frame 31 includes side portions 31*a* located on both sides of the sub-frame 31 in the right-and-left direction, and a base portion 31*b* serving as a link between the side portions 31*a*. The bearing 38 of the platen roller 7 is loosely inserted in a rear end portion of each of the side portions 31*a*. The platen unit 5 is mounted to the printer cover 12 through intermediation of the sub-frame 31.

As illustrated in FIG. 3, a pressure-applying mechanism 34 is provided between the main frame 30 and the sub-frame 31. The pressure-applying mechanism 34 is configured to urge (apply pressure to) the main frame 30 in a direction (downward direction) of separating the main frame 30 from the sub-frame 31 about a platen shaft 36. The pressure-applying mechanism 34 is, for example, a coil spring extending in the up-and-down direction. The pressure-applying mechanism 34 is arranged at a left end portion of the platen unit 5. Specifically, a lower end portion of the pressure-applying mechanism 34 is coupled to the sub-frame 31, and an upper end portion of the pressure-applying mechanism 34 is coupled to the coupling portion 30*b* of the main frame 30. It is only required that the pressure-applying mechanism 34 be arranged on at least any one of right and left end portions of the platen unit 5.

As illustrated in FIG. 5 and FIG. 6, the platen roller 7 is mounted to the platen frame 6 so as to be rotatable. When the platen unit 5 and the head unit 4 are combined with each other at the closing position of the printer cover 12, the platen roller 7 is arranged so that an outer peripheral surface of the platen roller 7 is held in contact with the thermal head 17 while sandwiching the recording sheet P together with the thermal head 17. The platen roller 7 is rotated, thereby feeding the recording sheet P. Specifically, the platen roller 7 includes the platen shaft 36 and a roller main body 37.

As illustrated in FIG. 3, the platen shaft 36 extends in the right-and-left direction. The bearing 38 is externally fitted to each end portion of the platen shaft 36. The bearing 38 is held in the shaft support portion 30*a* of the platen frame 6 (more specifically, main frame 30). The platen roller 7 is supported in the main frame 30 through intermediation of the bearings 38 so as to be rotatable. As illustrated in FIG. 6, a platen gear 39 is mounted to another end portion (right end portion) of the platen shaft 36. When the platen unit 5 and the head unit 4 are combined with each other, the platen gear 39 meshes with the platen gear train mechanism 23 of the head unit 4. When the platen motor (not shown) of the head unit 4 is rotated, the rotational force is transmitted to the platen gear 39 through the platen gear train mechanism 23, and thus the platen gear 39 is rotated. The roller main body 37 is mounted to an outer peripheral portion of the platen shaft 36. The roller main body 37 is made of an elastic material such as rubber.

The sensor holder 8 is arranged between the pair of shaft support portions 30*a* of the main frame 30. The sensor holder 8 extends in the right-and-left direction. Engagement claws 60 (see also FIG. 7) are formed integrally with an upper end of the sensor holder 8. The sensor holder 8 is locked to the main frame 30 by the engagement claws 60. The sensor holder 8 is arranged so as to cover a front side and a lower side of the platen roller 7.

Figure 7:
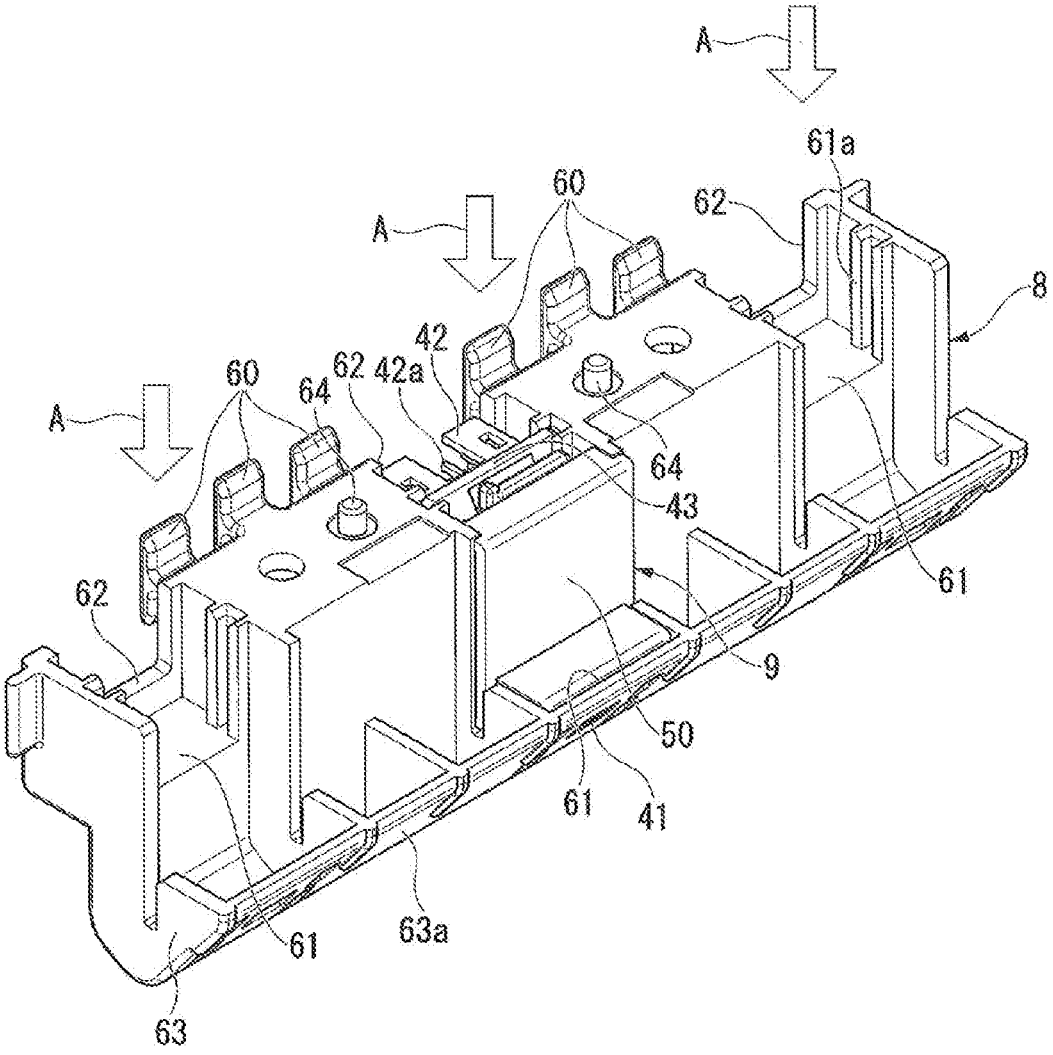
FIG. 7 is a perspective view for illustrating a sensor holder in the embodiment of the present invention.

FIG. 7 is a perspective view for illustrating the sensor holder 8 in the embodiment of the present invention. The sensor holder 8 includes sensor receiving portions 61, connector arrangement portions 62, and a sheet opposing portion 63. The sensor receiving portions 61 are recessed downward from an upper surface of the sensor holder 8. The plurality of (three in the embodiment of the present invention) sensor receiving portions 61 are formed at equal intervals in the right-and-left direction. The sensor unit 9 is inserted into one of the sensor receiving portions 61 from the upper side of the thermal printer (from a direction indicated by the arrows A of FIG. 7), and thus the sensor unit 9 is received in one of the sensor receiving portions 61. An insertion groove 61*a* is integrally formed in an inner wall of each of the sensor receiving portions 61 in the up-and-down direction (that is, the direction of inserting the sensor unit 9).

Between the adjacent sensor receiving portions 61, the engagement claw 60 described above and an engagement projecting portion 64 are formed. The engagement projecting portion 64 is formed on the upper surface of the sensor holder 8 located between the adjacent sensor receiving portions 61. The engagement projecting portion 64 protrudes upward from the upper surface of the sensor holder 8. The engagement projecting portion 64 is inserted in an engagement recessed portion (not shown) of the platen frame 6. With this configuration, the sensor holder 8 is positioned with respect to the platen frame 6.

Each of the connector arrangement portions 62 is formed on a front side of the sensor receiving portion 61. Each of the connector arrangement portions 62 allows communication between an inside and an outside of the sensor receiving portion 61. The plurality of (three in the embodiment of the present invention) connector arrangement portions 62 are formed in the right-and-left direction. The connector arrangement portions 62 are formed at positions corresponding to the sensor receiving portions 61, respectively. Under a state in which the sensor unit 9 is inserted in the sensor receiving portion 61, the connector arrangement portion 62 exposes a terminal 42*a* of a connector 42, which is described later, to the outside of the sensor holder 8.

The sheet opposing portion 63 protrudes downward and rearward from the sensor receiving portions 61. The sheet opposing portion 63 includes an inclined surface 63*a* directed downward and rearward. When the platen unit 5 and the head unit 4 are combined with each other, the inclined surface 63*a* of the sheet opposing portion 63 is parallel to the guide passage 90 of the head unit 4. The recording sheet P is arranged between the inclined surface 63*a* of the sheet opposing portion 63 and the guide passage 90. In other words, the sheet opposing portion 63 is opposed to the recording sheet P under a state in which the platen unit 5 and the head unit 4 are combined with each other. A plurality of (three in the embodiment of the present invention) sensor exposure windows 63*b* are formed in the sheet opposing portion 63. The sensor exposure windows 63*b* are formed so as to pass through the sheet opposing portion 63 in a direction orthogonal to the inclined surface 63*a*. Each of the sensor exposure windows 63*b* allows communication between the sensor receiving portion 61 and the outside of the sensor holder 8.

Figure 8:
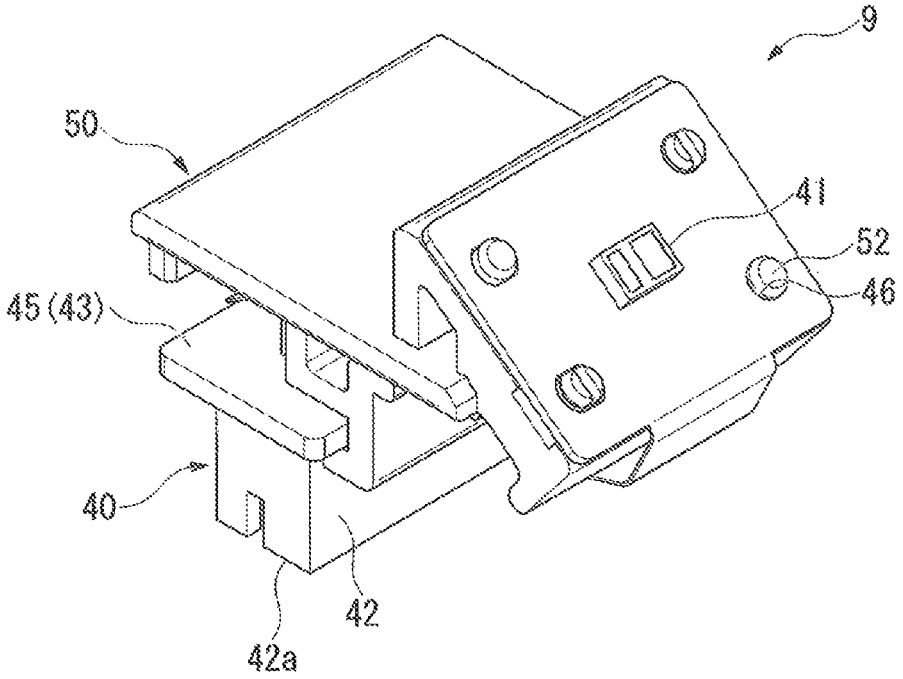
FIG. 8 is a perspective view for illustrating a sensor unit in the embodiment of the present invention.
Figure 9:
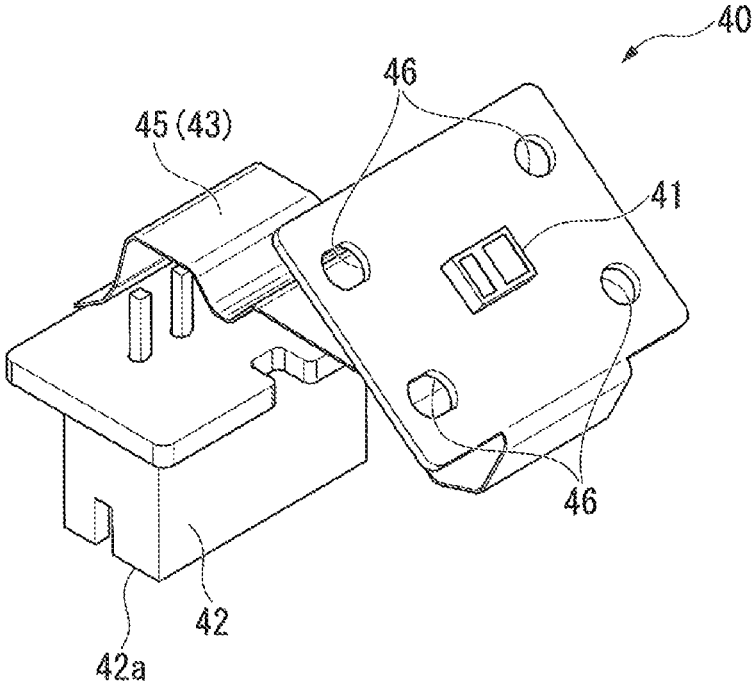
FIG. 9 is a perspective view for illustrating a sub-unit in the embodiment of the present invention.
Figure 10:
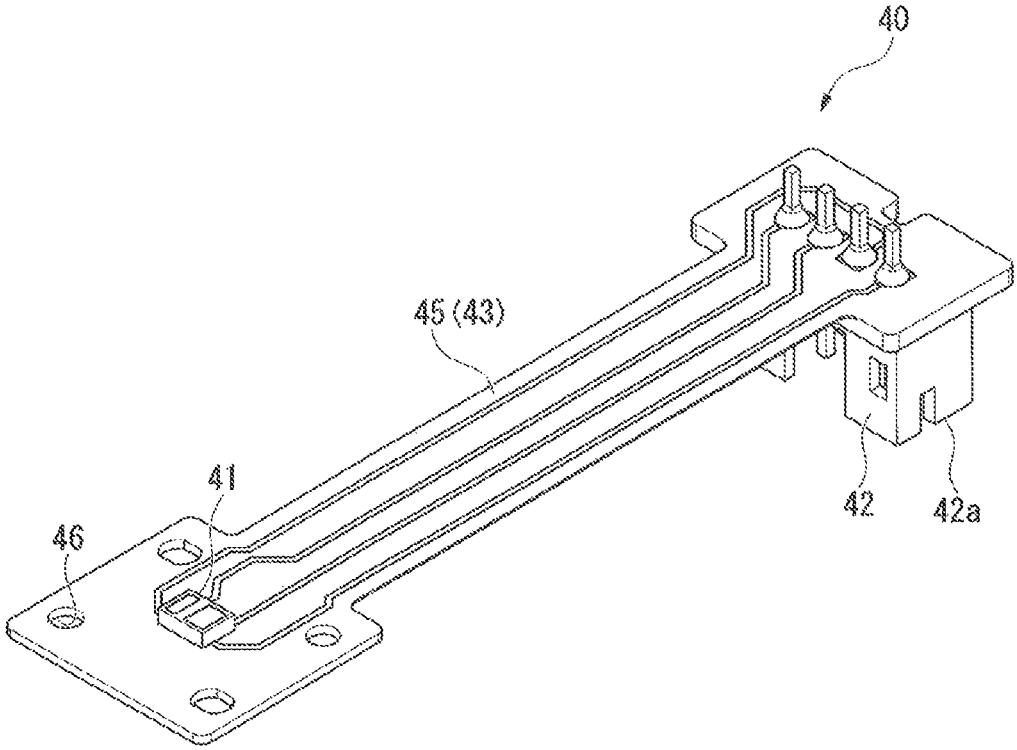
FIG. 10 is a perspective view for illustrating a sensor bracket in the embodiment of the present invention.
Figure 11:
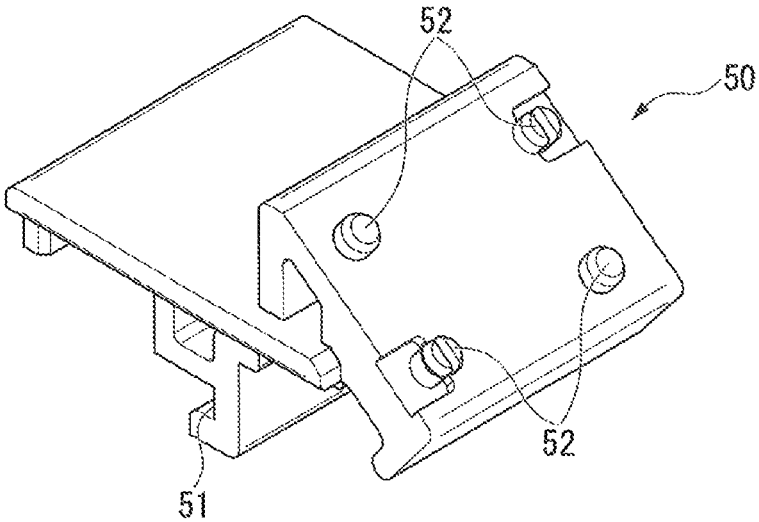
FIG. 11 is a developed view for illustrating the sub-unit in the embodiment of the present invention.

FIG. 8 is a perspective view for illustrating the sensor unit 9 in the embodiment of the present invention. FIG. 9 is a perspective view for illustrating a sub-unit 40 in the embodiment of the present invention. FIG. 10 is a developed view for illustrating the sub-unit 40 in the embodiment of the present invention. FIG. 11 is a perspective view for illustrating a sensor bracket 50 in the embodiment of the present invention. As illustrated in FIG. 7, the sensor unit 9 is received in a predetermined one (center sensor receiving portion 61 in the embodiment of the present invention) of the plurality of sensor receiving portions 61 formed in the sensor holder 8.

As illustrated in FIG. 8, the sensor unit 9 includes the sub-unit 40 and the sensor bracket 50. As illustrated in FIG. 9 and FIG. 10, the sub-unit 40 includes a sensor 41, the connector 42, and a connection portion 43. The sensor 41 is, for example, a photosensor. The sensor 41 is configured to detect a position of the recording sheet P. Specifically, in the embodiment of the present invention, the sensor 41 detects presence of marks formed in advance on the recording sheet P having, for example, a plurality of labels. The marks indicate, for example, printing start positions of the respective labels. The connector 42 is connected to the sensor 41. The terminal 42*a* of the connector 42 is connected to an external power supply unit PW (see FIG. 1) and a control board (not shown).

The connection portion 43 connects the sensor 41 and the connector 42 to each other. In the embodiment of the present invention, the connection portion 43 is a flexible board 45. The sensor 41 is mounted to one end portion of the flexible board 45 in a long-side direction thereof. The connector 42 is mounted to another end portion of the flexible board 45 in the long-side direction. With this configuration, the sensor 41 and the connector 42 are integrated with each other by the flexible board 45, and are electrically connected to each other. As illustrated in FIG. 9, the flexible board 45 is folded into a Z shape when seen from a short-side direction of the flexible board 45, and is retained by the sensor bracket 50 described later.

As illustrated in FIG. 8 and FIG. 11, the sensor bracket 50 fixes and retains the sub-unit 40. The sensor bracket 50 is made of a material such as a resin. The folded flexible board 45 can be mounted to the sensor bracket 50. The sensor bracket 50 includes an engagement portion 51 with which the flexible board 45 is engageable. Further, the sensor bracket 50 includes projecting portions 52 protruding toward the flexible board 45 side under a state in which the flexible board 45 is mounted to the sensor bracket 50. The projecting portions 52 are formed at positions corresponding to one end side of the flexible board 45 on which the sensor 41 is mounted. The projecting portions 52 are respectively inserted in hole portions 46 (see FIG. 9) formed in the flexible board 45.

The sensor unit 9 formed as described above is inserted into the sensor holder 8 from an upper side of the sensor holder 8 under a state in which the sensor 41 is directed downward. At this time, the sensor 41 is arranged in one of the sensor exposure windows 63*b* of the sheet opposing portion 63. Thus, under a state in which the sensor unit 9 is received in the sensor holder 8, the sensor 41 is exposed to the outside through the sensor exposure window 63*b*. Further, under this state, the connector 42 is arranged on one of the connector arrangement portions 62. Thus, the terminal 42*a* of the connector 42 is exposed to the outside through the connector arrangement portion 62. As illustrated in FIG. 2, wiring W connected to the terminal 42*a* of the connector 42 is routed to the casing main body 11 via the inner side of the printer cover 12, and is connected to the power supply unit PW in the casing main body 11 and to the control board (not shown).

Next, description is given of operation of performing printing on the recording sheet P through use of the thermal printer 1 described above. First, as illustrated in FIG. 2 and FIG. 3, under a state in which the printer cover 12 is at the closing position and the casing 2 and the printing unit 3 are combined with each other, the movable blade 20 and the fixed blade 33 are arranged at desired positions. At this time, the recording sheet P is sandwiched between the platen roller 7 and the thermal head 17. After being caused to pass through between the movable blade 20 and the fixed blade 33, an edge portion of the recording sheet P is drawn through the deliver port 15 to the outer side of the casing 2. The platen gear 39 on the platen unit 5 side meshes with the platen gear train mechanism 23 on the head unit 4 side.

Next, when the platen motor is driven, the rotational force is transmitted to the platen gear 39 of the platen unit 5. Thus, the platen roller 7 is rotated, and feeds the sheet while the platen roller 7 and the thermal head 17 sandwich the recording sheet P. Further, simultaneously with the sheet feeding, the heating elements of the thermal head 17 are caused to generate heat as appropriate, thereby performing printing, for example, various characters and graphics on the fed recording sheet P.

Here, the sensor 41 mounted to the platen unit 5 detects the mark formed between the adjacent labels on the recording sheet P. In accordance with the detection result, an amount of sheet feeding by the platen roller 7 is adjusted. In the embodiment of the present invention, the marks are formed in a region including a center portion of the recording sheet P in the short-side direction. Thus, owing to the sensor 41 received in the center sensor receiving portion 61, printing can be performed from a desired start position on the recording sheet P in the long-side direction. For example, in a case of using the recording sheet P on which the marks are formed at a right end thereof in the short-side direction, the sensor unit 9 is received in the right sensor receiving portion 61 of the plurality of sensor receiving portions 61. Similarly, for example, in a case of using the recording sheet P on which the marks are formed at a left end thereof in the short-side direction, the sensor unit 9 is received in the left sensor receiving portion 61 of the plurality of sensor receiving portions 61.

Next, the recording sheet P subjected to printing is caused to pass through between the fixed blade 33 and the movable blade 20. After the recording sheet P is caused to pass through between the blades by a predetermined length, the drive mechanism 93 is driven, and the movable blade 20 is slid toward the fixed blade 33. Thus, the recording sheet P is cut between the fixed blade 33 and the movable blade 20. As a result, a cut piece of the recording sheet P can be used as, for example, a receipt or a ticket.

Next, description is given of actions and effects of the printing unit 3 and the thermal printer 1 described above. According to the printing unit 3 having the configuration described above, the platen frame 6 of the platen unit 5 includes the plurality of sensor receiving portions 61. Therefore, the sensor unit 9 can be received in the desired sensor receiving portion 61 of the plurality of sensor receiving portions 61. Thus, for example, the sensor 41 can be arranged at a position corresponding to positions of the marks on the recording sheet P. Further, the position of the sensor 41 can be easily changed to be adapted to the recording sheets P different from each other in mark position by merely changing a position in which the sensor unit 9 is to be received. Thus, with a simple configuration, the marks on the recording sheet P can be reliably detected. The sensor unit 9 includes the sensor 41 and the connector 42. With this configuration, as compared to, for example, a configuration in which only the position of the sensor 41 can be changed, a length of the wiring (connection portion 43) connecting the sensor 41 and the connector 42 to each other can be reduced. Thus, cost required for parts can be reduced, and assembly workability at the time of manufacture can be improved. Further, the wiring is short, and hence it is not required to separately provide a space for receiving the wiring having a redundant length. Thus, the configuration of the printing unit 3 can be downsized. Therefore, with the configuration simpler and smaller than the configuration of the related art, there can be provided the printing unit 3 capable of performing position detection on the recording sheets P different from each other in mark position.

The sensor 41 and the connector 42 are mounted to the single board (flexible board 45), and thus are electrically connected to each other. With this configuration, the sensor 41 and the connector 42 can be connected to each other without electric wires, and the sensor unit 9 can have a simple configuration. Thus, the number of parts can be reduced, and workability when a position of receiving the sensor unit is changed can be improved. The flexible board 45 retains the sensor 41 and the connector 42 in an integrated state, and hence the flexible board 45, the sensor 41, and the connector 42 can be integrally moved so as to be received in the desired sensor receiving portion 61. Accordingly, for example, as compared to a case of using a board having a redundant length in order to be adapted to different detection positions, a size of the flexible board 45 corresponding to a movement range can be minimized. Further, it is not required that, for example, a space for receiving the board having a redundant length be provided in the sensor holder 8, and hence the sensor holder 8 can be downsized.

The sensor unit 9 includes the sub-unit 40 and the sensor bracket 50. The sub-unit 40 includes the flexible board 45. Accordingly, under a state in which the sensor 41 and the connector 42 are connected to the flexible board 45, the sub-unit 40 can be easily mounted to the sensor bracket 50. Further, the sub-unit 40 is received in the sensor receiving portion 61 integrally with the sensor bracket 50, and hence strength of the sensor unit 9 can be increased as compared to a case in which the sensor bracket 50 is not provided. Thus, positioning accuracy of the sensor 41 can be improved.

The flexible board 45 is engageable with the engagement portion 51 of the sensor bracket 50. With this configuration, the sensor bracket 50, and the sub-unit 40 including the flexible board 45 can be easily integrated with each other to form the sensor unit 9. Thus, with the simple configuration, workability at the time of manufacture can be improved.

According to the thermal printer 1 having the configuration described above, the printing unit 3 is assembled to the casing 2, thereby forming the thermal printer 1. The printing unit 3 includes the sensor holder 8 including the plurality of sensor receiving portions 61, and the sensor unit 9 including the sensor 41. The sensor unit 9 is received in the sensor receiving portion 61. With this configuration, the sensor unit 9 can be received in the desired sensor receiving portion 61, and the sensor 41 can be arranged at the position corresponding to the mark positions on the recording sheet P. Therefore, with the configuration simpler and smaller than the configuration of the related art, there can be provided the thermal printer 1 capable of achieving both simplification and satisfaction of a user's need through use of the printing unit 3 capable of performing position detection on the recording sheets P different from each other in mark position.

The technical scope of the present invention is not limited to the embodiment described above. Various modifications can be made thereto without departing from the gist of the present invention. For example, in the embodiment of the present invention, description is given of the configuration in which the flexible board 45 is mounted to the sensor bracket 50, thereby forming the sensor unit 9. However, the present invention is not limited thereto. The sensor bracket 50 may be omitted. That is, for example, the sub-unit 40, in which the sensor 41 and the connector 42 are mounted to a board having high rigidity, may be received as the sensor unit 9 in the sensor receiving portion 61. However, the embodiment of the present invention, in which the sensor bracket 50 is provided, holds superiority in terms of being capable of improving ease of assembling the sensor unit 9 into the sensor receiving portion 61 while increasing rigidity of the sensor unit 9.

As the connection portion 43, an electric wire may be used in place of the flexible board 45. In this case, the sensor 41 and the connector 42 may be connected to each other by wiring, and the sensor bracket 50 may include, for example, the engagement portion 51 for fixing the wiring. However, the configuration of the embodiment of the present invention, in which the flexible board 45 is employed as the connection portion 43, holds superiority in terms of being capable of reducing the number of parts and of easily mounting the sub-unit 40 to the sensor bracket 50. The number of the sensor receiving portions 61 is not limited to that in the embodiment described above.

In the embodiment described above, description is given of the configuration in which the fixed blade 33 is mounted to the platen frame 6 and the movable blade 20 is mounted to the head frame 18, but the present invention is not limited thereto. There may be adopted a configuration in which the movable blade 20 is mounted to the platen frame 6 and the fixed blade 33 is mounted to the head frame 18.

Besides the above, the components in the above-mentioned embodiment may be replaced by well-known components as appropriate without departing from the gist of the present invention. The above-mentioned examples may be combined with each other as appropriate.

What is claimed is:

1. A printing unit, comprising:

a head unit including a thermal head; and a platen unit combined with the head unit, the platen unit including:

a platen roller configured to feed a recording sheet while sandwiching the recording sheet together with the thermal head;

a platen frame configured to support the platen roller in a rotatable manner;

a sensor unit including:

a sensor configured to detect the recording sheet;

a connector connected to the sensor; and a connection portion configured to connect the sensor and the connector to each other; and a sensor holder, which is mounted to the platen frame, and includes:

a plurality of connector arrangement portions through which a terminal of the connector is to be exposed; and a plurality of sensor receiving portions in which the sensor unit is to be received.

2. The printing unit according to claim 1, wherein the connection portion is a board, and wherein the sensor and the connector are mounted to the single board.

3. The printing unit according to claim 2, wherein the board is a flexible board, and wherein the sensor unit includes:

a sub-unit including the sensor, the connector, and the flexible board that are integrated with one another; and a sensor bracket to which the sub-unit is mounted.

4. The printing unit according to claim 3, wherein the sensor bracket includes an engagement portion with which the flexible board is engageable.

5. A printer, comprising:

the printing unit of claim 1; and a casing to which the printing unit is assembled.

* * * * *